US008469679B2

(12) United States Patent
Ogasawara et al.

(10) Patent No.: US 8,469,679 B2
(45) Date of Patent: Jun. 25, 2013

(54) SEALED TYPE ROTARY COMPRESSOR

(75) Inventors: Hirotsugu Ogasawara, Ota (JP); Takahiro Nishikawa, Ora-gun (JP); Yoshihisa Kogure, Ora-gun (JP); Kazuhiko Arai, Ota (JP); Hiroyuki Yoshida, Ota (JP)

(73) Assignee: SANYO Electric Co., Ltd., Moriguchi, Osaka (JP)

( * ) Notice: Subject to any disclaimer, the term of this patent is extended or adjusted under 35 U.S.C. 154(b) by 547 days.

(21) Appl. No.: 12/688,144

(22) Filed: Jan. 15, 2010

(65) Prior Publication Data

US 2010/0215525 A1 Aug. 26, 2010

(30) Foreign Application Priority Data

Feb. 20, 2009 (JP) ..... 2009-037821

(51) Int. Cl.
*F04B 39/06* (2006.01)

(52) U.S. Cl.
USPC ..... 417/372; 417/369; 417/902

(58) Field of Classification Search
USPC ..... 417/366, 369, 372, 902, 410.3
See application file for complete search history.

(56) References Cited

U.S. PATENT DOCUMENTS 4,717,316 A * 1/1988 Muramatsu et al. ..... 417/372
5,464,332 A * 11/1995 Beck et al. ..... 417/368
6,527,523 B1 * 3/2003 Iida et al. ..... 417/410.3
6,634,870 B2 * 10/2003 Dreiman et al. ..... 417/368
2005/0002803 A1 * 1/2005 Kim ..... 417/410.3

FOREIGN PATENT DOCUMENTS

JP 03-213693 A 9/1991
JP 9-151885 A 6/1997
JP 3992071 B1 10/2007

* cited by examiner

*Primary Examiner* — Charles Freay
*Assistant Examiner* — Patrick Hamo
(74) *Attorney, Agent, or Firm* — Westerman, Hattori, Daniels & Adrian, LLP

(57) ABSTRACT

An object of the present invention is to promote oil separation in a sealed container, thereby decreasing the amount of oil discharged to the outside of a compressor. The compressor comprises discharge hole provided at position facing the end surface of a rotor and through which a compressed refrigerant from first and second rotary compression elements is discharged into the sealed container; and a refrigerant flow path which is extended from a space surrounded with a coil end of a stator projecting from the end surface of the rotor to a rotary compression mechanism side to a space of an air gap between the rotor and the stator, to guide the compressed refrigerant discharged through the discharge hole to an electromotive element opposite to the rotary compression mechanism side. The outlet of this refrigerant flow path opposite to the rotary compression mechanism side faces the inner wall surface of the sealed container, and the volume of a space between the inner wall surface of the sealed container and the electromotive element is 1.5 times or more and 15 times or less that of a space between the rotary compression element and the electromotive element.

3 Claims, 4 Drawing Sheets

SEALED TYPE ROTARY COMPRESSOR

BACKGROUND OF THE INVENTION

The present invention relates to a sealed type rotary compressor including an electromotive element and a rotary compression element in a sealed container. More particularly, it relates to a sealed type rotary compressor in which a rotary compression element is received in the lower part of a sealed container and in which an electromotive element is received above this rotary compression element, the electromotive element being constituted of a stator, and a rotor rotatably inserted into a magnetic field generated by this stator and fixed to a rotary shaft which also serves as a crank shaft to drive the rotary compression element.

Heretofore, this type of sealed type rotary compressor is constituted of a rotary compression element received in the lower part of a sealed container and an electromotive element received above the rotary compression element. The electromotive element is constituted of a ring-shaped stator attached along the inner peripheral-surface of the upper space of the sealed container, and a rotor rotatably inserted into a magnetic field generated by this stator and fixed to a rotary shaft which also serves as a crank shaft to drive the rotary compression element.

The rotary compression element is constituted of a cylinder, a roller fitted into an eccentric portion formed in the rotary shaft to eccentrically rotate in the cylinder, and a vane which abuts on the cylinder to divide the inside of the cylinder into a low pressure chamber side and a high pressure chamber side. Moreover, in the bottom part of the sealed container, oil for lubricating sliding portions such as the rotary compression element and the rotary shaft is stored.

Moreover, when a stator winding of the stator of the electromotive element is electrically energized to generate a rotation magnetic field, the rotor provided in this magnetic field rotates. By this rotation, the roller fitted into the eccentric portion of the rotary shaft eccentrically rotates in the cylinder. In consequence, a low pressure refrigerant is sucked on the low pressure chamber side in the cylinder, and compressed by the operations of the roller and the vane. The refrigerant gas compressed in this cylinder to have a high temperature and a high pressure is discharged from the high pressure chamber side to a discharge muffler through a discharge port. The refrigerant gas discharged to the discharge muffler is discharged into the sealed container through discharge hole which connect the discharge muffler to the sealed container and which are directed upwardly to the electromotive element. At this time, the oil supplied to the rotary compression element and having a mist state is mixed in the refrigerant gas, and the oil is discharged together with the refrigerant gas into the sealed container.

The refrigerant gas discharged into the sealed container passes through a refrigerant passage formed in the electromotive element and is discharged to the outside of a discharge pipe provided above the electromotive element (see e.g., JP-A-9-151885).

However, in such a conventional sealed type rotary compressor, the refrigerant gas and the oil cannot sufficiently be separated in the sealed container, and the amount of the oil discharged through the discharge pipe is large, which causes problems that performance deteriorates owing to the outflow of the oil to an external circuit and that the oil supplied to the sliding portions runs short.

The present invention has been developed to solve such problems of the conventional technology, and an object thereof is to promote oil separation in the sealed container, thereby decreasing the amount of the oil discharged to the outside of the compressor.

SUMMARY OF THE INVENTION

According to the present invention, there is provided a sealed type rotary compressor in which a rotary compression element is received in the lower part of a sealed container and in which an electromotive element is received above this rotary compression element, this electromotive element being constituted of a stator, and a rotor rotatably inserted into a magnetic field generated by this stator and fixed to a rotary shaft which also serves as a crank shaft to drive the rotary compression element, the compressor comprising: a discharge hole provided at positions facing the end surface of the rotor and through which a compressed refrigerant from the rotary compression element is discharged into the sealed container; and a refrigerant flow, path which is extended, from a space surrounded with a coil end of the stator projecting from the end surface of the rotor to a rotary compression element side to a space of an air gap between the rotor and the stator, to guide the compressed refrigerant discharged through the discharge hole to the electromotive element opposite to the rotary compression element side, characterized in that the outlet of this refrigerant flow path opposite to the rotary compression element side faces the inner wall surface of the sealed container and in that the volume of a space between the inner wall surface of the sealed container and the electromotive element is 1.5 times or more and 15 times or less that of a space between the rotary compression element and the electromotive element.

According to the present invention, there is provided the sealed type rotary compressor in which the rotary compression element is received in the lower part of the sealed container and in which the electromotive element is received above this rotary compression element, the electromotive element being constituted of the stator, and the rotor rotatably inserted into the magnetic field generated by this stator and fixed to the rotary shaft which also serves as the crank shaft to drive the rotary compression element. The compressor comprises the discharge hole provided at the position facing the end surface of the rotor and through which the compressed refrigerant from the rotary compression element is discharged into the sealed container; and the refrigerant flow path which is extended from the space surrounded with the coil end of the stator projecting from the end surface of the rotor to the rotary compression element side to the space of the air gap between the rotor and the stator, to guide the compressed refrigerant discharged through the discharge hole to the electromotive element opposite to the rotary compression element side, whereby the compressed refrigerant discharged through the discharge hole is caused to collide with the end surface of the rotating rotor, and can be stirred. This can promote oil separation in the space surrounded with the coil end of the stator.

Moreover, the compressed refrigerant guided through the space surrounded with the coil end of the stator is twisted by the wall surfaces of the stator and the rotating rotor, while passing through the space of the air gap between the stator and the rotor, whereby oil can further be separated.

Furthermore, the outlet of this refrigerant flow path opposite to the rotary compression element side faces the inner wall surface of the sealed container. Therefore, the refrigerant passing through the refrigerant flow path to reach the electromotive element opposite to the rotary compression element side collides with the inner wall surface of the sealed container, diffuses in the space of the electromotive element opposite to the rotary compression element side, and is then discharged to the outside of the sealed container. In this way, the diffusion in the space of the electromotive element opposite to the rotary compression element side further enables separating the oil. In consequence, the oil separation is efficiently performed, and the oil discharged to the outside of the compressor can noticeably be decreased.

In particular, the volume of the space between the inner wall surface of the sealed container and the electromotive element is 1.5 times or more and 15 times or less that of the space between the rotary compression element and the electromotive element, whereby the vertical dimension of the sealed container is not increased but the volume of the space between the inner wall surface of the sealed container and the electromotive element can be acquired to acquire an oil separation space by the diffusion of the refrigerant in the final stage, thereby improving an oil separation effect.

DETAILED DESCRIPTION OF THE PREFERRED EMBODIMENT

Figure 1:
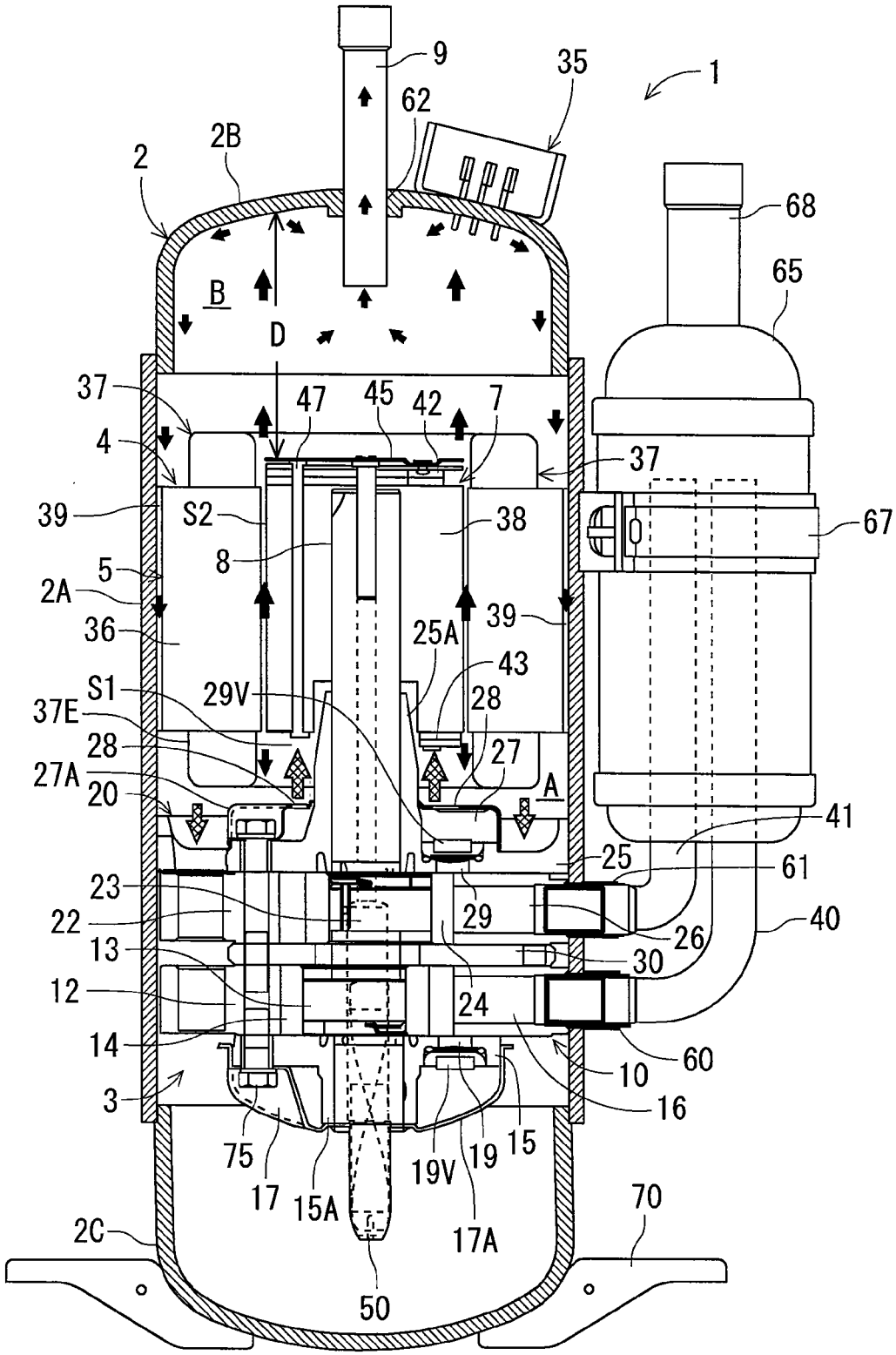
FIG. 1 is a vertically sectional side view schematically showing a sealed type rotary compressor of one embodiment to which the present invention is applied.

Hereinafter, an embodiment of a sealed type rotary compressor of the present invention will be described in detail with reference to the drawings. FIG. 1 is a diagram schematically showing the vertically sectional side surface of an internal high pressure type rotary compressor 1 including first and second rotary compression elements as one embodiment of the sealed type rotary compressor to which the present invention is applied.

The rotary compressor 1 of the present embodiment is a two-cylinder sealed type rotary compressor in which a rotary compression mechanism 3 including first and second rotary compression elements 10, 20 is received in the lower part of the internal space of a vertically cylindrical sealed container 2 formed of a steel plate and in which an electromotive element 4 is received above the rotary compression mechanism.

The sealed container 2 is constituted of a container main body 2A in which the electromotive element 4 and the first and second rotary compression elements 10, 20 (the rotary compression mechanism 3) are received; a substantially bowl-like end cap (a lid member) 2B which closes an upper opening of this container main body 2A; and a bottom part 2C which closes a lower opening of the container main body 2A. The upper surface of the end cap 2B is provided with a circular attachment hole (not shown), and in this attachment hole, a terminal (a wiring line is omitted) 35 for supplying a power to the electromotive element 4 positioned in the upper part of the sealed container 2 is attached. Furthermore, in the center of the end cap 2B, a refrigerant discharge pipe 9 described later is attached.

A space in the bottom part of the sealed container 2 is an oil reservoir where oil for lubricating sliding portions such as the first and second rotary compression elements 10, 20 and a rotary shaft 8 is stored. Moreover, on the external bottom portion of the bottom part 2C, mounting base 70 is provided.

The rotary compression mechanism 3 is constituted of the first rotary compression element 10, the second rotary compression element 20, and an intermediate partition plate 30 sandwiched between both the rotary compression elements 10 and 20. In the rotary compression mechanism 3 of the present embodiment, the first rotary compression element 10 is provided under the intermediate partition plate 30, and the second rotary compression element 20 is provided above the intermediate partition plate. The first rotary compression element 10 and the second rotary compression element 20 are constituted of cylinders 12, 22 disposed under and above the intermediate partition plate 30; rollers 14, 24 which are fitted into eccentric portions 13, 23 provided in the rotary shaft 8 with a phase difference of 180 degrees in the cylinders 12, 22, to eccentrically rotate in the cylinders 12, 22, respectively; vanes (not shown) which abut on the rollers 14, 24 to divide the insides of the cylinders 12, 22 into low pressure chamber sides and high pressure chamber sides, respectively; and a lower support member 15 and an upper support member 25 as support members which close the lower open surface of the cylinder 12 and the upper open surface of the cylinder 22, respectively, and which also serve as bearings of the rotary shaft 8.

The lower and upper cylinders 12, 22 are provided with suction passages 16, 26 which communicate with compression chambers in the cylinders 12, 22, respectively. Moreover, the lower support member 15 opposite to an electromotive element 4 side (the downside) and an electromotive element 4 side (the upside) of the upper support member 25, discharge mufflers 17, 27 are provided, respectively.

The discharge muffler 17 positioned under the lower support member 15 is formed by covering the lower surface of the lower support member 15 with a substantially bowl-like lower cup 17A having a center hole through which the rotary shaft 8 and a lower bearing 15A of the lower support member 15 extend. The discharge muffler 17 is connected to the cylinder 12 through a discharge passage 19, and a discharge valve 19V provided in an opening of the discharge passage 19 on a discharge muffler 17 side can closably be opened to connect the discharge muffler 17 to the cylinder 12 (on the high pressure chamber side of the cylinder 12).

Moreover, the discharge muffler 27 positioned above the upper support member 25 is formed by covering the upper surface of the upper support member 25 with a substantially bowl-like upper cup 27A having a center hole through which the rotary shaft 8 and an upper bearing 25A of the upper support member 25 extend. The discharge muffler 27 is connected to the cylinder 22 through a discharge passage 29, and a discharge valve 29V provided in an opening of the discharge passage 29 on a discharge muffler 27 side can closably be opened to connect the discharge muffler 27 to the cylinder 22 (on the high pressure chamber side of the cylinder 22).

The discharge muffler 17 is connected to the discharge muffler 27 through a communication path (not shown) which extends through the lower support member 15, the lower cylinder 12, the intermediate partition plate 30, the upper cylinder 22 and the upper support member 25 in an axial center direction (a vertical direction).

Figure 2:
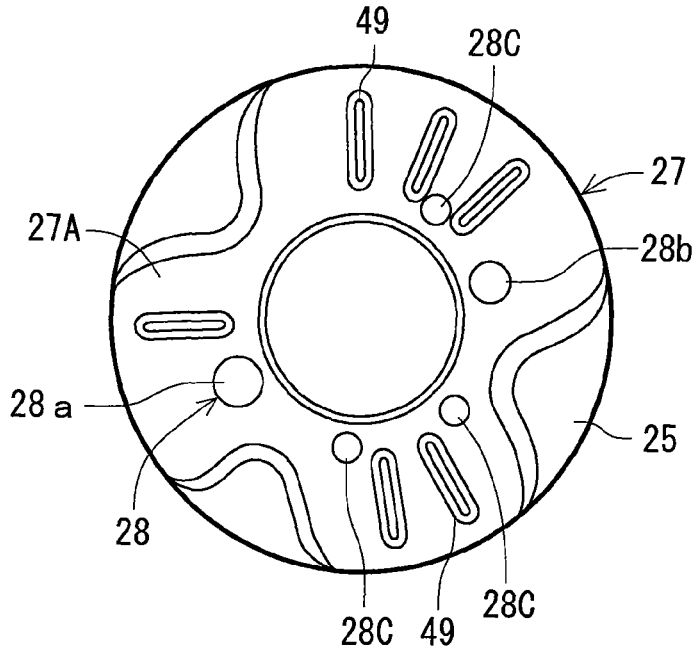
FIG. 2 is a plan view of a discharge muffler having discharge holes in the sealed type rotary compressor of FIG. 1.

As shown in FIG. 2, the upper cup 27A of the discharge muffler 27 is provided with a plurality of discharge holes 28 for discharging a compressed refrigerant from the respective rotary compression elements 10, 20 into the sealed container 2. The discharge holes 28 are circular holes extended through the upper cup 27A in the axial center direction (the vertical direction), and all the discharge holes 28 are formed in the vicinity of the rotary shaft 8 provided in the center of the upper cup 27A so as to face the end surface (the lower end surface) of a rotor 7 of the electromotive element 4. That is, the discharge holes 28 are directed to the end surface (the lower end surface) of the rotor 7.

The refrigerant gas flows counterclockwise in the discharge muffler 27 of the present embodiment shown in FIG. 2, and the hole diameters, number and arrangement of the discharge holes 28 are set so that the pulsation of the refrigerant gas can effectively be absorbed (decreased) in the discharge muffler 27. The discharge holes 28 of the present embodiment shown in FIG. 2 include a discharge hole 28*a* having an inner diameter of 10 mm, a discharge hole 28*b* disposed substantially symmetrically with respect to the discharge hole 28*a* around the rotary shaft 8, and three discharge holes 28*c* each having an inner diameter of 6 mm.

Moreover, the discharge hole 28*b* is provided with a facing discharge valve (not shown). It is to be noted that reference numeral 49 shown in FIG. 2 indicates slots formed in the upper cup 27A.

It is to be noted that a bolt 75 shown in FIG. 1 is a bolt which integrally fixes the upper support member 25, the upper cylinder 22, the intermediate partition plate 30, the lower cylinder 12 and the lower support member 15.

On the other hand, the electromotive element 4 is constituted of a ring-shaped stator 5 fixedly welded along the inner peripheral surface of an upper space of the sealed container 2; and the rotor 7 rotatably inserted into a magnetic field generated by the stator 5.

The stator 5 is constituted a stator iron core 36 having a constitution in which stator iron plates formed of substantially ring-shaped electromagnetic steel plates (silicon steel plates) are laminated, and a stator coil 37 wound around the stator iron core 36. A coil end 37E of the stator coil 37 is provided so as to project from the end surface (the lower end surface) of the rotor 7 to a rotary compression mechanism 3 side (the downside), whereby in the end surface (the lower end surface) of the rotor 7 on the rotary compression mechanism 3 side (the downside), a space S1 surrounded with the coil end 37E is formed. Moreover, in the outer peripheral surface of the stator iron core 36, a plurality of vertical grooves 39 are formed along the inner peripheral surface of the container main body 2A in the axial center direction, and the vertical grooves 39 are used as passages through which the oil returns as described later.

The rotor 7 is constituted of a cylindrical rotor iron core 38 in which a permanent magnet (not shown) formed of an electromagnetic steel plate (a silicon steel plate) is embedded and whose upper and lower end surfaces are flat; and the rotary shaft 8 which is forced and fixedly inserted into a center through hole of the rotor iron core 38. The rotary shaft 8, which also serves as a crank shaft to drive the first and second rotary compression elements 10, 20, passes through the center of the sealed container to extend in the vertical direction, and the upper end of the rotary shaft 8 is positioned at the upper end of the rotor iron core 38. Moreover, the lower end of the rotary shaft 8 is positioned in the oil reservoir under the rotary compression mechanism 3, and immersed into the oil stored in this oil reservoir. The lower portion (the lower end) of the rotary shaft 8 is provided with an oil pump 50 for sucking up the oil from the oil reservoir.

Furthermore, the upper and lower end surfaces of the rotor 7 (the rotor iron core 38) are provided with weight balance adjusting balancers 42, 43 which suppress vibration generated by the eccentric rotation of the rotary shaft 8 due to the weight differences between the eccentric portions 13 and 23 and between the rollers 14 and 24 in the first and second rotary compression elements 10, 20, to stabilize the rotation. On the upper surface of the balancer 42, a stop plate 45 for the balancer is provided. Moreover, the members (the balancers 42, 43 and the stop plate 45) arranged on the end surface of the rotor iron core 38 are fixed to the rotor iron core 38 via a rivet 47.

Furthermore, a distance D between the end surface of the rotor 7 opposite to the rotary compression mechanism 3 side and the inner wall surface of the sealed container 2 in the direction of the rotary shaft 8, that is, the distance D between the upper surface of the stop plate 45 provided on the upper end surface of the rotor 7 and the inner wall surface of the end cap 2B of the sealed container 2 corresponding to and disposed above the upper surface of the stop plate in the present embodiment is 25 mm or more.

Additionally, the electromotive element 4 is provided with a refrigerant flow path through which the compressed refrigerant discharged through the discharge holes 28 (i.e., the discharge holes 28*a*, 28*b* and 28*c*) to a space A between the rotary compression mechanism 3 and the electromotive element 4 in the sealed container 2 is guided to the electromotive element 4 opposite to the rotary compression mechanism 3 side. This refrigerant flow path is constituted of the space S1 surrounded with the coil end of the stator 5 projecting from the end surface (the lower end surface) of the rotor 7 to the rotary compression mechanism 3 side (the downside), and a space S2 of an air gap between the rotor 7 and the stator 5.

That is, the refrigerant discharged through the discharge holes 28 to the space A between the rotary compression mechanism 3 and the electromotive element 4 in the sealed container 2 passes through the space S1 surrounded with the coil end of the stator 5 projecting from the end surface of the rotor 7 to the rotary compression mechanism 3 side (the downside), passes through the space S2 of the ring-shaped air gap between the rotor 7 and the stator 5, and is discharged through an upper end opening (i.e., an outlet of the refrigerant flow path) to a space (i.e., the space of the electromotive element 4 opposite to the rotary compression mechanism 3 side in the sealed container 2) B between the inner wall surface of the sealed container 2 and the electromotive element. The outlet of the refrigerant flow path opposite to the rotary compression mechanism 3 side (i.e., the upper end opening of the space S2 of the air gap) faces the inner wall surface of the sealed container 2.

On the other hand, on the side surface of the container main body 2A of the sealed container 2, sleeves 60, 61 are welded and fixed to positions corresponding to the suction passages 16, 26 of the cylinders 12, 22, respectively. These sleeves 60, 61 are disposed so as to be vertically adjacent to each other.

Moreover, in the sleeve 60, a refrigerant introduction pipe 40 for introducing the refrigerant gas into the lower cylinder 12 is inserted and connected, and one end of the refrigerant introduction pipe 40 communicates with the suction passage 16 of the lower cylinder 12. The other end of the refrigerant introduction pipe 40 opens in the upper part of an accumulator 65.

In the sleeve 61, a refrigerant introduction pipe 41 for introducing the refrigerant gas into the upper cylinder 22 is inserted and connected, and one end of the refrigerant introduction pipe 41 communicates with the suction passage 26 of the upper cylinder 22. The other end of the refrigerant introduction pipe 41 opens in the upper part of the accumulator 65 in the same manner as in the refrigerant introduction pipe 40.

The accumulator 65 is a tank in which the gas-liquid separation of the sucked refrigerant is performed, and is attached to the side surface of the upper part of the container main body 2A of the sealed container 2 via a bracket 67. Moreover, the refrigerant introduction pipes 40 and 41 are inserted into the bottom part of the accumulator 65, and the other end opening of each refrigerant introduction pipe is positioned in the upper part of the accumulator 65. Furthermore, one end of a refrigerant pipe 68 is inserted into the upper end of the accumulator 65.

On the other hand, the end cap 2B of the sealed container 2 is provided with a substantially circular center hole 62 at a position facing the rotary shaft 8. In the hole 62, the refrigerant discharge tube 9 is inserted and connected, and one end of the refrigerant discharge tube 9 opens in the upper part of the sealed container 2. One end opening of the refrigerant discharge tube 9 is directed to the inside of the ring-shaped refrigerant flow path (i.e., the space S2 of the air gap between the stator 5 and the rotor 7).

Particularly in the present invention, when the volume of a space B between the inner wall surface of the sealed container 2 and the electromotive element 4 (the space above the electromotive element 4 opposite to the rotary compression mechanism 3 side) is larger than that of the space A between the rotary compression mechanism 3 and the electromotive element 4, an oil separation performance improves. Therefore, the electromotive element 4 is disposed in consideration of the height dimension thereof in the sealed container 2 so that the volume of the space B above the electromotive element is 1.5 times or more and 15 times or less that of a space A under the electromotive element.

An operation of the rotary compressor 1 of the present embodiment having the above constitution will be described. When the stator coil 37 of the electromotive element 4 is electrically energized via the terminal 35 and the wiring line (not shown), the electromotive element 4 starts up to rotate the rotor 7. By this rotation, the rollers 14, 24 fitted into the eccentric portions 13, 23 integrally provided in the rotary shaft 8 eccentrically rotate in the cylinders 12, 22, respectively.

In consequence, the low pressure refrigerant flows through the refrigerant pipe 68 of the compressor 1 into the accumulator 65. The low pressure refrigerant which has flowed into the accumulator 65 is subjected to the gas-liquid separation therein, and then the only refrigerant gas enters the refrigerant introduction pipes 40, 41 disposed in the accumulator 65. The low pressure refrigerant gas which has entered the refrigerant introduction pipe 40 passes through the suction passage 16, and is sucked into the low pressure chamber side of the cylinder 12 of the first rotary compression element 10.

The refrigerant gas sucked into the low pressure chamber side of the cylinder 12 is compressed by the operations of the roller 14 and the vane (not shown) to have a high temperature and a high pressure, and the refrigerant gas passes from the high pressure chamber side of the cylinder 12 through the discharge passage 19, and is discharged to the discharge muffler 17. The refrigerant gas discharged to the discharge muffler 17 is discharged to the discharge muffler 27 through the communication path (not shown), and joins the refrigerant gas compressed by the second rotary compression element 20.

On the other hand, the low pressure refrigerant gas which has entered the refrigerant introduction pipe 41 passes through the suction passage 26, and is sucked into the low pressure chamber side of the upper cylinder 22 of the second rotary compression element 20. The refrigerant gas sucked into the low pressure chamber side of the upper cylinder 22 is compressed by the operations of the roller 24 and the vane (not shown) to have a high temperature and a high pressure, and the refrigerant gas passes from the high pressure chamber side of the upper cylinder 22 through the discharge passage 29, and is discharged to the discharge muffler 27 to join the refrigerant gas discharged from the first rotary compression element 10.

Moreover, the joined refrigerant gas is discharged to the space A between the rotary compression mechanism 3 and the electromotive element 4 in the sealed container 2 through the discharge through holes 28 formed in the upper cup 27A. At this time, the oil supplied to the sliding portions of the rotary compression mechanism 3 in the form of mist is mixed in the refrigerant gas, and the oil is discharged together with the refrigerant gas through the discharge holes 28. It is to be noted that arrows shown in FIG. 1 indicate the flow of the oil discharged together with the compressed refrigerant into the sealed container 2.

Here, since the discharge holes 28 are provided at the positions facing the lower end surface of the rotor iron core 38 of the rotor 7, the compressed refrigerant discharged through the discharge holes 28 collides with the lower end surface of the rotor iron core 38 of the rotating rotor 7, is stirred, and is diffused in the space S1 surrounded with the coil end 37E of the stator coil 37 of the stator 5.

Figure 6:
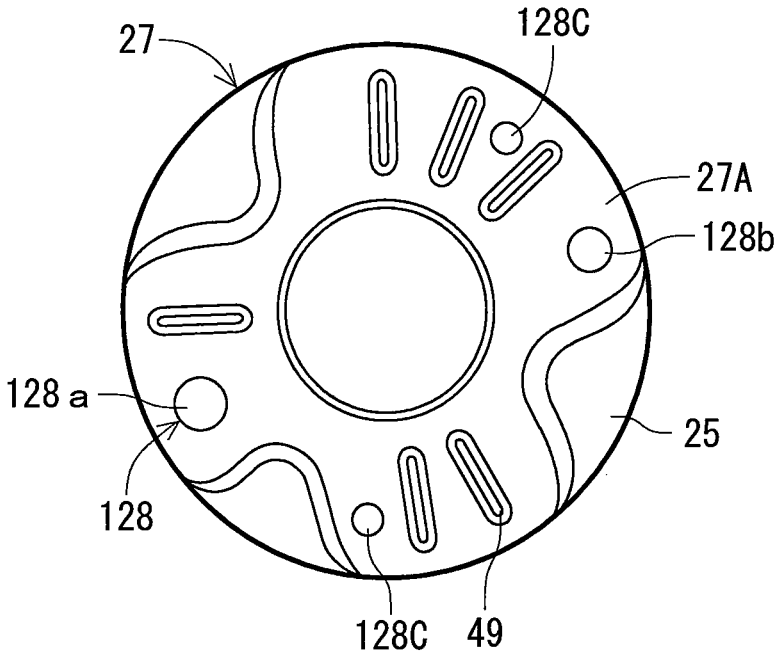
FIG. 6 is a plan view of a conventional discharge muffler having discharge holes.

Here, conventional discharge holes 128 provided in the upper cup 27A will be described with reference to FIG. 6. In FIG. 6, a discharge hole 128*a* has an inner diameter of 10 mm, a discharge hole 128*b* has an inner diameter of 8 mm, and each of discharge holes 128*c* has an inner diameter of 6 mm. All the discharge holes are arranged in consideration of the effect of the refrigerant gas pulsation absorption in the discharge muffler 27. However, all the conventional discharge holes 128 shown in FIG. 6 are disposed away from the center of the upper cup 27A in the vicinity of the outer peripheral edge of the cup, and are positioned so as to face the space S2 of the air gap between the rotor 7 and the stator 5 in the electromotive element 4. That is, the compressed refrigerant discharged into the sealed container 2 through the discharge holes 128 directly flows into the space S2 of the air gap between the rotor 7 and the stator 5 because the discharge holes 128 are directed to the space.

Moreover, in addition to the space S2 of the air gap, another refrigerant flow path for guiding the refrigerant to the electromotive element 4 opposite to the rotary compression mechanism 3 side is formed. For example, the space A extended through the rotor 7 in the axial center direction (the vertical direction) between the rotary compression mechanism 3 and the electromotive element 4 is connected to the space B between the inner wall surface of the sealed container 2 and the electromotive element 4 to form the refrigerant passage, whereby the compressed refrigerant discharged through the discharge hole is guided to this refrigerant passage or the refrigerant passage and space S2 of the air gap.

In this way, according to the conventional constitution, the compressed refrigerant discharged through the discharge hole is hardly subjected to the oil separation in the space A between the rotary compression mechanism 3 and the electromotive element 4, but directly flows into the refrigerant flow path for guiding the refrigerant to the electromotive element 4 opposite to the rotary compression mechanism 3 side.

On the other hand, according to the present invention, the discharge holes 28 are provided so as to face the end surface (the lower end surface) of the rotor iron core 38 of the rotor 7, whereby the compressed refrigerant discharged into the sealed container 2 through the discharge holes 28 can collide with the lower end surface of the rotor iron core 38 of the rotor 7 directed by the discharge holes 28. In consequence, the oil can separated in the space A between the rotary compression mechanism 3 and the electromotive element 4 in the sealed container 2. In particular, when the compressed refrigerant discharged through the discharge holes 28 is caused to collide with the lower end surface of the rotor iron core 38 of the rotating rotor 7, the refrigerant can be stirred by the rotation of the rotor iron core 38, and can broadly be diffused over the space S1 surrounded with the coil end 37E of the stator coil 37 of the stator 5. In consequence, the oil separation in the space S1 surrounded with the coil end 37E of the stator 5 can be promoted.

Afterward, the refrigerant discharged through the space S1 passes through the space S2 of the air gap between the stator 5 and the rotor 7. The space S2 of the air gap is a small gap formed between the stator 5 and the rotor 7. Moreover, the rotor 7 positioned in the small gap rotates, whereby the refrigerant passing through the space S2 is influenced by the rotation of the rotor 7, and flows so as to rise through the space S2 while being twisted in the rotating direction of the rotor 7. In consequence, the oil can further be separated from the refrigerant passing through the space S2.

The refrigerant, from which the oil is separated while passing through the space S2 of the air gap between the stator 5 and the rotor 7, is discharged to the space B of the electromotive element 4 opposite to the rotary compression mechanism 3 side through the outlet of the space S2. At this time, since this outlet is provided so as to face the inner wall surface of the sealed container 2, the refrigerant discharged through the outlet collides with the inner wall surface of the sealed container 2 to diffuse in the space B. In this way, the diffusion in the space B of the electromotive element 4 opposite to the rotary compression mechanism 3 side enables further separating the oil.

In particular, the one end opening of the refrigerant discharge tube 9 for guiding the compressed refrigerant diffused in the space B of the sealed container 2 to the outside of the sealed container 2 is directed to the inside of the ring-shaped refrigerant flow path in the sealed container 2 (i.e., the space S2 of the air gap), so that the compressed refrigerant which has reached the electromotive element 4 opposite to the rotary compression mechanism 3 side through the refrigerant flow path can be inhibited from directly reaching the refrigerant discharge tube 9. In consequence, an oil separation performance can be improved.

Furthermore, the distance D between the upper surface of the stop plate 45 provided on the upper end surface of the rotor 7 and the inner wall surface of the end cap 2B of the sealed container 2 corresponding to and disposed above the stop plate is 25 mm or more, whereby an oil separation space of the electromotive element 4 opposite to the rotary compression mechanism 3 side is sufficiently secured, and the oil separation performance can further be improved.

In particular, the volume of the space B above the electromotive element 4 opposite to the rotary compression mechanism 3 side is 1.5 times or more and 15 times or less that of the space A between the rotary compression mechanism 3 and the electromotive element 4. Specifically, in the above constitution of the present invention, to improve the oil separation performance in the sealed container 2, it is necessary to acquire the sufficient oil separation space for sufficiently diffusing the refrigerant in the electromotive element 4 opposite to the rotary compression mechanism 3 side immediately before a stage (the final stage) where the refrigerant is discharged to the outside of the sealed container 2. In this way, when the vertical dimension of the sealed container 2 is increased to sufficiently acquire the oil separation space above the electromotive element 4 opposite to the rotary compression mechanism 3 side, a problem occurs that the rotary compressor 1 enlarges or that change in the design of the sealed container 2 incurs the steep increase of cost.

To solve the problem, to acquire the oil separation space opposite to the rotary compression mechanism 3 side without increasing the vertical dimension of the sealed container 2, in the present invention, the space B above the electromotive element 4 opposite to the rotary compression mechanism 3 side is adjusted so as to be larger than the volume of the space A between the rotary compression mechanism 3 and the electromotive element 4, thereby acquiring the appropriate oil separation space.

That is, the volume of the space B above the electromotive element 4 opposite to the rotary, compression mechanism 3 side is 1.5 times or more and 15 times or less that of the space A between the rotary compression mechanism 3 and the electromotive element 4, whereby the vertical dimension of the sealed container 2 is not increased but the volume of the space B between the inner wall surface of the sealed container 2 and the electromotive element 4 can be acquired to acquire the oil separation space by the diffusion of the refrigerant in the final stage, thereby improving the oil separation effect.

Afterward, the refrigerant diffused in the space B enters the refrigerant discharge tube 9 through the opening directed to the inside of the refrigerant flow path (the space S2 of the air gap), and is discharged to the outside of the sealed container 2.

On the other hand, the oil separated from the refrigerant in the space B flows downwardly along the vertical grooves 39 formed between the container main body 2A of the sealed container 2 and the stator 5, to return to the oil reservoir in the bottom part of the sealed container 2.

As described above in detail, according to the present invention, the oil discharged together with the compressed refrigerant into the sealed container 2 can efficiently be separated in the sealed container 2, and the amount of the oil discharged to the outside of the rotary compressor 1 through the refrigerant discharge tube 9 can noticeably be decreased. In consequence, the oil can smoothly be supplied to the sliding portions of the rotary compressor 1, the performance of the rotary compressor 1 is secured, and reliability can be improved.

Furthermore, since the amount of the oil discharged to the outside of the rotary compressor 1 is decreased, the disadvantageously adverse effect of the oil on the external circuit can be suppressed.

Figure 3:
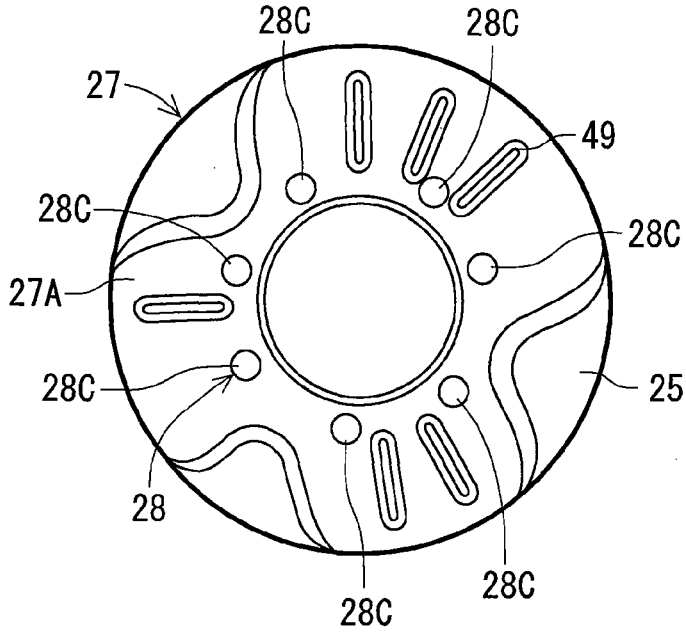
FIG. 3 is a plan view of another discharge muffler having discharge holes.
Figure 4:
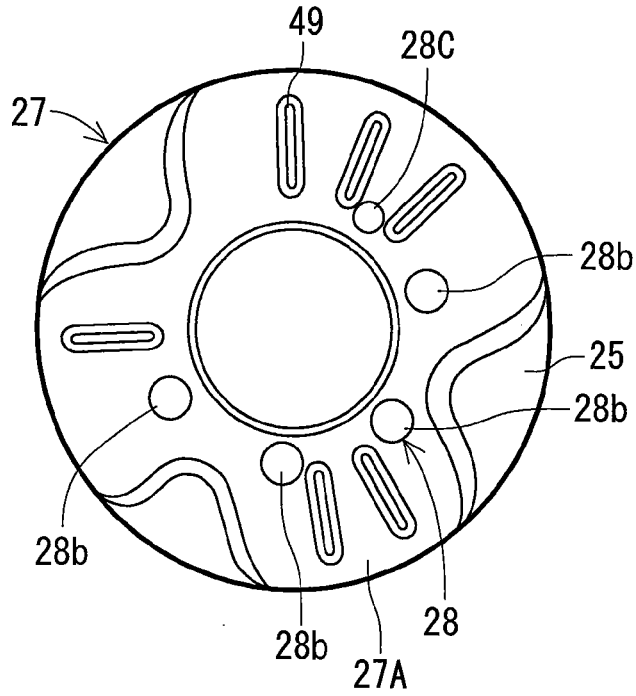
FIG. 4 is a plan view of still another discharge muffler having discharge holes.

It is to be noted that in the present invention, there is not any special restriction on the discharge holes as long as they are positioned so as to face the end surface of the rotor. As long as the discharge holes can be provided so as to effectively absorb (decrease) the pulsation of the refrigerant gas in the discharge muffler 27, there is not any special restriction on the diameters, number, arrangement and the like of the discharge holes 28 of the embodiment shown in FIG. 2. For example, as shown in FIG. 3, six discharge holes 28*c* each having an inner diameter of 6 mm may equally be spaced from one another and arranged around the rotary shaft 8. As shown in FIG. 4, four discharge holes 28*b* each having an inner diameter of 8 mm and one discharge hole 28*c* having an inner diameter of 6 mm may be provided in the vicinity of the rotary shaft 8.

Figure 5:
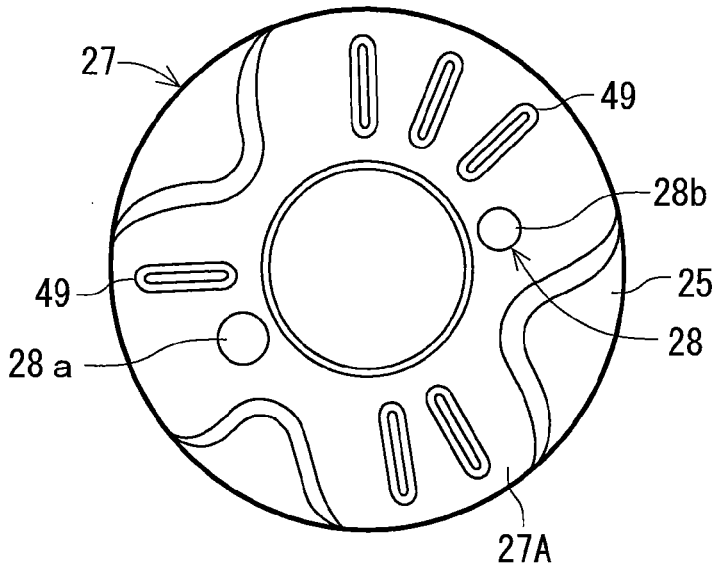
FIG. 5 is a plan view of a further discharge muffler having discharge holes.

Alternatively, as shown in FIG. 5, discharge holes may only include a discharge hole 28*a* having an inner diameter of 10 mm, and a discharge hole 28*b* having an inner diameter of 8 mm and disposed substantially symmetrically with respect to the discharge hole 28*a* around the rotary shaft 8.

Moreover, in the present embodiment, the present invention applied to the two-cylinder sealed type rotary compressor has been described, but is not limited to the embodiment, and the present invention applied to, for example, a one-cylinder sealed type rotary compressor or a multistage compression type compressor is also effective.

What is claimed is:

1. A sealed type rotary compressor comprising a sealed container, a rotary compression element received in a lower part of the sealed container, and an electromotive element received in the sealed container above the rotary compression element, the electromotive element comprising a stator, and a rotor rotatably inserted into a magnetic field generated by the stator and fixed to a rotary shaft which also serves as a crank shaft to drive the rotary compression element, the compressor comprising:

a discharge hole provided at a position facing an end surface of the rotor and through which a compressed refrigerant from the rotary compression element is discharged into the sealed container; and a refrigerant flow path which is extended from a space surrounded with a coil end of the stator, the coil end projecting from the end surface of the rotor to a rotary compression element side, to a space of an air gap between the rotor and the stator, to guide the compressed refrigerant discharged through the discharge hole to the electromotive element opposite to the rotary compression element side, wherein the outlet of the refrigerant flow path opposite to the rotary compression element side faces an inner wall surface of the sealed container, and wherein the volume of a space between the inner wall surface of the sealed container and the electromotive element is 1.5 times or more and 15 times or less that of a space between the rotary compression element and the electromotive element.

2. The sealed type rotary compressor according to claim 1, wherein the rotary compression element comprises a cylinder and a roller eccentrically rotating in the cylinder, and wherein the discharge hole is disposed on a top surface of the rotary compression element and communicatively connected to the cylinder through a discharge passage such that the compressed refrigerant is discharged from the cylinder through the discharge passage to the discharge hole.

3. The sealed type rotary compressor according to claim 1, further comprising a vertical groove formed between an inner surface of the sealed container and the stator to provide a return passage such that an oil separated from the refrigerant flows down along the return passage from the space between the inner wall surface of the sealed container and the electromotive element.

* * * * *